US010474063B2

(12) United States Patent
Kawasumi

(10) Patent No.: US 10,474,063 B2
(45) Date of Patent: Nov. 12, 2019

(54) IMAGE FORMING APPARATUS HAVING MOVABLE SHUTTER MEMBER

(71) Applicant: CANON KABUSHIKI KAISHA, Tokyo (JP)

(72) Inventor: Ryoichi Kawasumi, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/805,220

(22) Filed: Nov. 7, 2017

(65) Prior Publication Data

US 2018/0143566 A1 May 24, 2018

(30) Foreign Application Priority Data

Nov. 18, 2016 (JP) ..... 2016-225549

(51) Int. Cl.
*G03G 15/08* (2006.01)
*G03G 21/16* (2006.01)

(52) U.S. Cl.
CPC ..... *G03G 15/0886* (2013.01); *G03G 21/1676* (2013.01)

(58) Field of Classification Search
None
See application file for complete search history.

(56) References Cited

U.S. PATENT DOCUMENTS

| | | | | |
|---|---|---|---|---|
| 9,235,161 | B2 | 1/2016 | Kawasumi | |
| 9,606,474 | B2 | 3/2017 | Kawasumi | |
| 2009/0142105 | A1* | 6/2009 | Yanagi | G03G 15/0891 399/265 |
| 2011/0211868 | A1* | 9/2011 | Yamamoto | G03G 15/0879 399/119 |
| 2014/0140725 | A1* | 5/2014 | Kawasumi | G03G 15/0879 399/119 |

FOREIGN PATENT DOCUMENTS

| | | | |
|---|---|---|---|
| JP | S62-116970 | A | 5/1987 |
| JP | 2009-210966 | A | 9/2009 |
| JP | 2011-145384 | A | 7/2011 |
| JP | 2014-102425 | A | 6/2014 |

* cited by examiner

*Primary Examiner* — Victor Verbitsky
(74) *Attorney, Agent, or Firm* — Venable LLP

(57) ABSTRACT

An image forming apparatus includes an apparatus body, a photosensitive member unit including a photosensitive member on which an electrostatic latent image is formed, and a developing unit including a developer carrying member configured to carry a developer toward a position for developing the electrostatic latent image formed on the photosensitive member with the developer. A moving mechanism moves a shutter member from a shielding position to an open position in conjunction with pressurization of the developing unit mounted to the apparatus body in a pressurizing direction so that a transition is made from a state in which a developer receiving portion is shielded to a state in which the developer receiving portion is opened after the developing unit is guided in a mounting direction and then mounted to the apparatus body.

3 Claims, 9 Drawing Sheets

IMAGE FORMING APPARATUS HAVING MOVABLE SHUTTER MEMBER

BACKGROUND OF THE INVENTION

Field of the Invention

The present invention relates to an image forming apparatus such as a copying machine, printer, and facsimile apparatus that employ an electrophotographic process or electrostatic recording process.

Description of the Related Art

An image forming apparatus employing an electrophotographic process includes a developing device that is configured to develop an electrostatic image formed on an image bearing member using a developer. The developing device may be made detachable so as to be inserted or extracted with respect to an apparatus body of the image forming apparatus for replacement or the like (Japanese Patent Application Laid-Open No. 2009-210966).

This developing device is provided with a replenishment port that is adapted to receive a developer supplied from a replenishing device. When the developing device is removed from the apparatus body, this replenishment port is closed by a shutter member.

There is a configuration in which the developing device is moved to a position for image forming after being mounted in the image forming apparatus. When a shutter is employed for the configuration, there is the following problem. When the developing device is mounted in the image forming apparatus, the shutter is released while a distance between the replenishment port of the developing device and a replenishment port of the image forming apparatus is large. As a result, the shutter cannot function sufficiently.

SUMMARY OF THE INVENTION

An object of the present invention is to provide an image forming apparatus for which a timing of opening/closing a shutter for opening/closing a replenishment port is optimized with a simple configuration, the image forming apparatus employing a configuration in which a developing device is moved in the image forming apparatus.

Another objective of the present invention is to provide an image forming apparatus including: an image bearing member; a developing device configured to develop an electrostatic image formed on the image bearing member with a developer; a replenishing portion configured to replenish the developer to the developing device; a replenishment port disposed in the developing device and configured to receive the developer replenished from the replenishing portion; a shutter member disposed in the developing device and configured to open and close the replenishment port; a separate/approach mechanism configured to move the developing device to a first position for forming an image and to a second position farther than the first position from the image bearing member; and a moving mechanism configured to move the shutter member from a closed position to an opened position in conjunction with a movement of the developing device from the second position to the first position by the separate/approach mechanism, the shutter member blocking the replenishment port at the closed position, and the shutter member releasing the replenishment port at the opened position.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, an image forming apparatus according to the present invention will be described more in detail with reference to the accompanying drawings.

[Embodiment 1]

1. Schematic Configuration of Image Forming Apparatus

Figure 1:
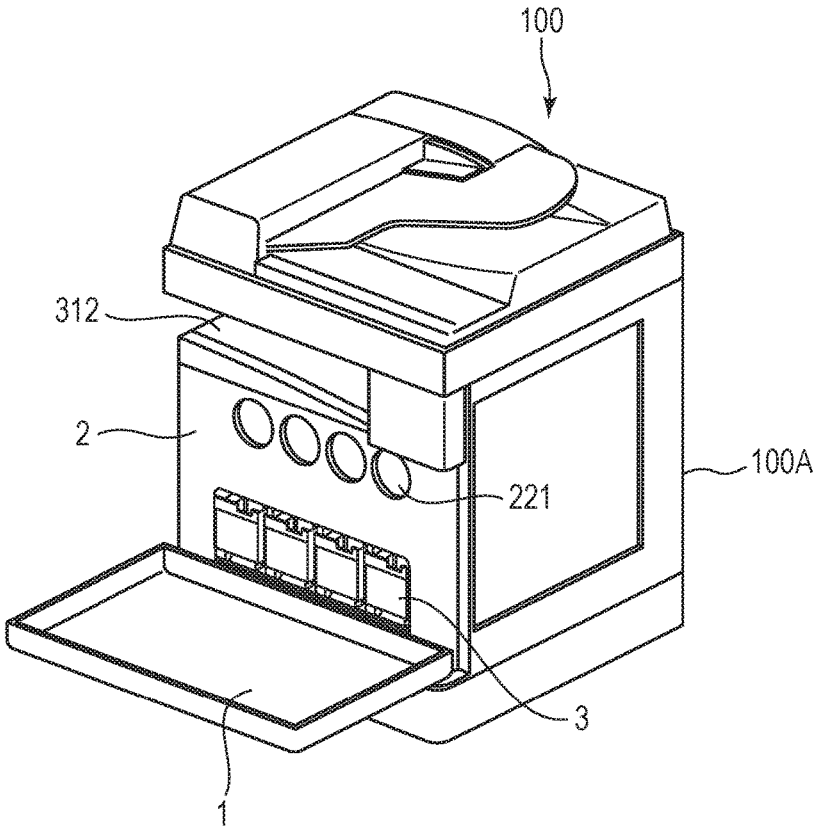
FIG. 1 is a perspective view of an image forming apparatus with a front cover opened.

FIG. 1 is a perspective view illustrating a front side, a right side, and an upper side of an image forming apparatus 100. In FIG. 1, the image forming apparatus 100 is illustrated in a situation in which a front cover 1 provided on a front side of an apparatus body 100A is opened. The image forming apparatus 100 further includes an inner cover 2 and four small covers 3, and FIG. 2 is a perspective view of the image forming apparatus 100 illustrating a disposition of units laying inside the apparatus body 100A by drawing the inner cover 2, the four small covers 3, and a frame body illustrated in FIG. 1 partially in perspective.

In the image forming apparatus 100, the term "front" refers to one end side in a rotation axis direction of a photosensitive drum 210. An operator normally performs attaching/detaching operation of a developing unit 220 from the front side. The term "back" refers to the other end side of the photosensitive drum 210 in the rotation axis direction. The terms "left" and "right" respectively refer to the right and the left when the image forming apparatus 100 is viewed from the front side. The terms "up" and "down" respectively refer to the up and the down in a gravity direction but do not respectively mean being directly above and being directly below only, but also respectively imply an upper side and a bottom side of a level surface passing through a target position or a target element. In addition, in the image forming apparatus 100, a front-back direction (substantially parallel to the rotation axis direction of the photosensitive drum 210) may be referred to as a "longitudinal direction".

Figure 2:
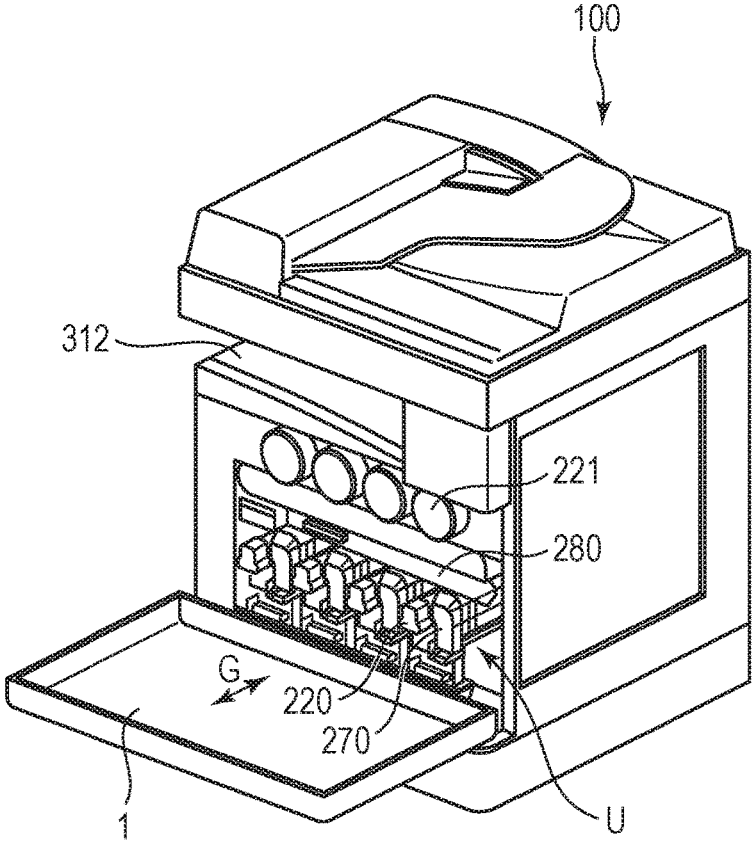
FIG. 2 is a perspective view of the image forming apparatus with a portion of an inner configuration drawn in perspective.

As illustrated in FIG. 2, the apparatus body 100A includes, at a substantially center, four process units U for image forming (see FIG. 3) arranged in a horizontal direction. The four process units U form images of respective different colors (yellow, magenta, cyan, and black). The process units U each include a drum unit 270 (image bearing member unit) and a developing unit 220. The four process units U have substantially the same configuration except that colors of toners contained in the respective developing units 220 are different from one another (in FIG. 2, only the rightmost process unit U is indicated by reference numeral). Above the four process units U, an intermediate transfer belt 280 is disposed. The intermediate transfer belt 280 is made up of an endless belt and put across a plurality of support rollers (not illustrated) and looped around the support rollers at a predetermined tension. Above the intermediate transfer belt 280, four toner cartridges 221 are arranged in the horizontal direction. The toner cartridges 221 contains toners with which the developing units 220 of the four process units U are to be replenished. The four toner cartridges 221 have substantially the same configuration except that colors of toners contained in the toner cartridges 221 are different from one another (in FIG. 2, only the right end toner cartridge 221 is indicated by reference numeral). On the rear side of the inside of the apparatus body 100A, toner replenishing units 222 (see FIG. 4) as replenishing portions are disposed in such a manner as to correspond to the respective four developing units 220. The replenishing portions are configured to replenish the respective developing units 220 with toners from the respective toner cartridges 221.

The image forming apparatus 100 includes laser units 223 (see FIG. 4) that are disposed below the respective process units U, and a sheet cassette (not illustrated) that is disposed in a lower portion of the apparatus body 100A and adapted to accommodate a sheet (a transfer material). The image forming apparatus 100 also includes a sheet conveying path (not illustrated) and a second transfer roller (not illustrated). The sheet conveying path is disposed in a lateral portion on the right side of the inside of the apparatus body 100A. The second transfer roller forms a second transferring part by being contacted with an outer circumferential surface of the intermediate transfer belt 280 on a conveying path for a sheet formed by the sheet conveying path. The image forming apparatus 100 also includes a fixing device that is disposed on the conveying path for a sheet formed by the sheet conveying path. The image forming apparatus 100 also includes a tray 312, on which sheets passing through the fixing device are to be stacked, in an upper portion of the apparatus body 100A.

Figure 3:
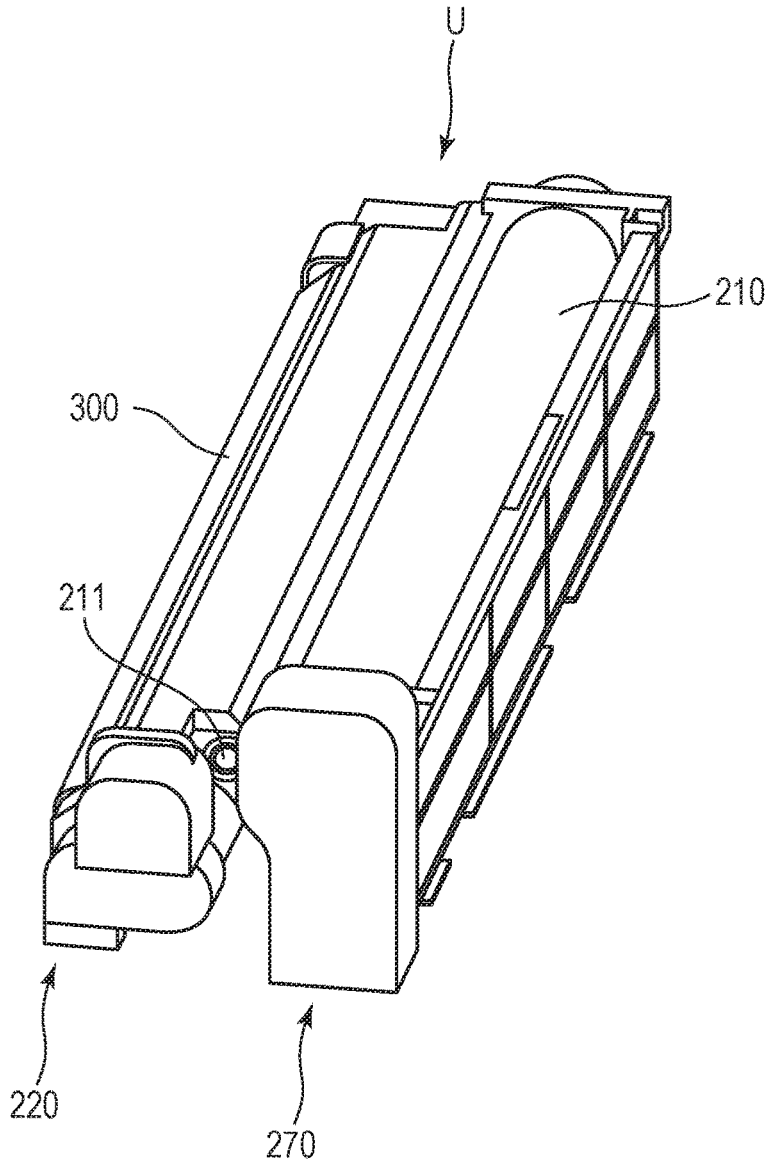
FIG. 3 is a perspective view of a process unit.
Figure 4:
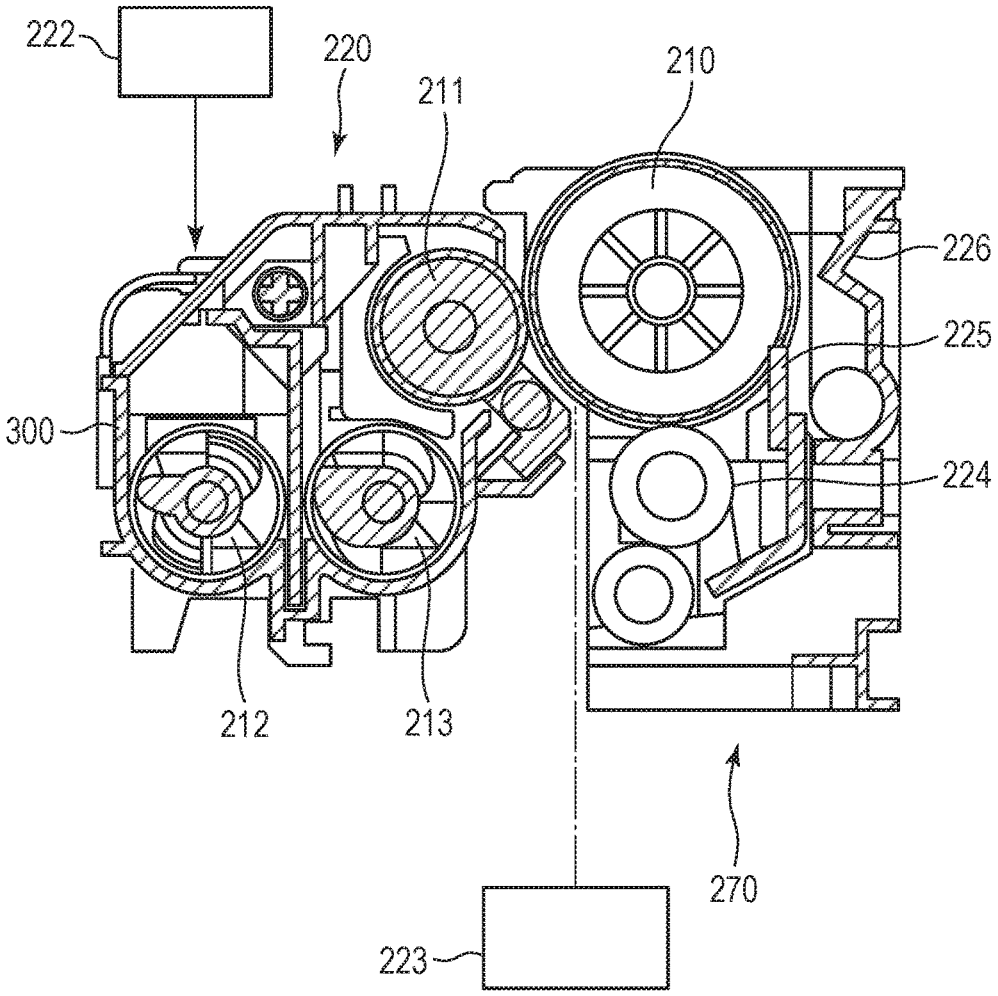
FIG. 4 is a cross-sectional view of the process unit.

FIG. 3 is a perspective view illustrating a front side, a right side, and an upper side of a process unit U. FIG. 4 is a cross-sectional view of the process unit U (schematically illustrating the toner replenishing unit 222 and the laser unit 223). The process unit U includes a drum unit 270 and a developing unit 220. The drum unit 270 includes a photosensitive drum 210, a charging roller 224, a cleaning blade 225, and a drum unit container 226 that is adapted to support these components. The photosensitive drum 210 is a photosensitive member (electrophotographic photosensitive member) of a drum type (having a cylindrical shape) and serves as an image bearing member. The developing unit 220 will be described later in detail. In each of the process units U, the developing unit 220 and the drum unit 270 are independent of each other and capable of being inserted into or extracted from the apparatus body 100A to be detachable.

Below the process unit U, the laser unit 223 (exposing portion) is disposed. Thereby a relative position relationship is limited between the drum unit 270 and the developing unit 220 in a cross section that is substantially perpendicular to a rotation axis of the photosensitive drum 210. That is, a laser beam from the laser unit 223 is applied to a bottom surface of the photosensitive drum 210 from below. For that reason, the developing unit 220 needs to be brought close to a lateral side so as not to block the laser beam. The developing unit 220 includes a developing roller 211 that is disposed facing the photosensitive drum 210. For the above reason, the developing unit 220 is disposed in such a manner that an arrangement angle of the developing roller 211 with respect to a horizontal line passing through a rotation center of the photosensitive drum 210 (an angle formed between the rotation center of the photosensitive drum 210 and a straight line passing through the rotation center of the developing roller 211) falls within a range of about 60 degrees.

As illustrated in FIG. 1, the image forming apparatus 100 includes the front cover 1 as a door that allows access to the inside of the apparatus body 100A. The image forming apparatus 100 also includes the four small covers 3 such that each of the small covers 3 covers, inside the front cover 1, at least a portion of an end portion on a front side of the developing unit 220 and the drum unit 270 in a corresponding process unit U. In a manner described below, the developing unit 220 or the drum unit 270 is attached to or detached from the apparatus body 100A, or replaced. First, the front cover 1 is opened from the front side of the apparatus body 100A, and then a small cover 3, provided in each process unit U, is opened. Thereby, an end portion on a front side of a target unit is exposed to an outside of the apparatus body 100A. Then a developing unit 220 or a drum unit 270 is inserted or extracted in an arrow G direction (front-back direction) illustrated in FIG. 2.

In the present embodiment, lifetimes of the developing unit 220 and the drum unit 270 are set to be shorter than a lifetime of the apparatus body 100A. The developing unit 220 and the drum unit 270 need to be replaced when reaching the respective lifetimes. In many cases, the lifetimes are represented as the number of sheets that are output with images formed thereon. For example, assuming that the lifetime of the apparatus body 100A is equivalent to 500 K of sheets, the lifetime of the drum unit 270 is commonly set at one equivalent to 50 K sheets. In such a case, the drum unit 270 needs about ten replacements within a time period represented by the lifetime of the apparatus body 100A.

2. Image Forming Operation Next, an image forming operation of the image forming apparatus 100 will be described. When the image forming operation is started, a sheet is fed one by one from the sheet cassette provided in the lower portion of the apparatus body 100A and conveyed to the second transferring part along the sheet conveying path.

In the process unit U, a surface of the photosensitive drum 210 is uniformly subjected to a charging process by the charging roller 224. The surface subjected to the charging process is scanned with and exposed to light by the laser unit 223 according to image information, and an electrostatic image (electrostatic latent image) is thereby formed on the photosensitive drum 210. The electrostatic image formed on the photosensitive drum 210 is developed (made visible) by the developing unit 220 using a developer, so that a toner image is formed on the photosensitive drum 210. In a primary transferring part, the intermediate transfer belt 280 is brought into contact with the photosensitive drum 210. In the primary transferring part, the toner image formed on the photosensitive drum 210 is primary transferred on the intermediate transfer belt 280 by an action of a primary transfer roller (not illustrated) disposed on an inner circumferential surface side of the intermediate transfer belt 280. For example, in the formation of a full-color image, toner images of a plurality of colors are formed on the photosensitive drums 210 of the respective four process units U. The formed toner images of the plurality of colors are primary transferred on the intermediate transfer belt 280 one by one so as to be superposed on one another.

Thereafter, in a second transferring part, the toner images on the intermediate transfer belt 280 are secondarily transferred on the sheet by an action of the second transfer roller. The toner images subjected to the second transfer on the sheet are fixed (fused and adhered) in the fixing device, before the sheet is ejected (output) on the tray 312.

3. Developing Unit

Figure 5:
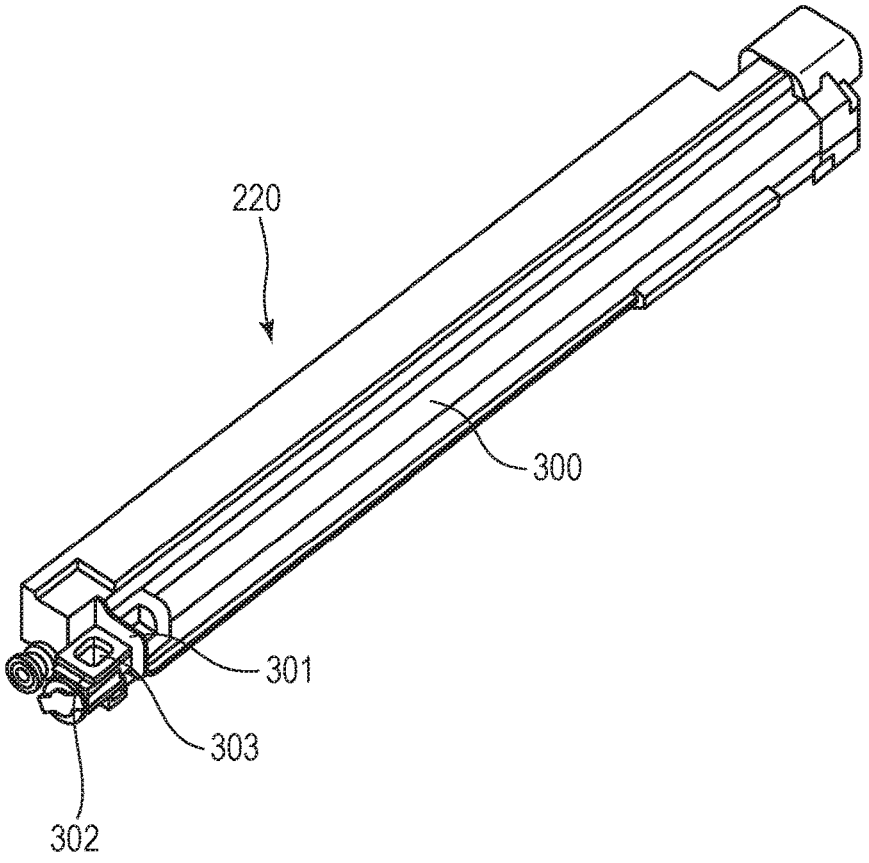
FIG. 5 is a perspective view of a developing unit.
Figure 6A:
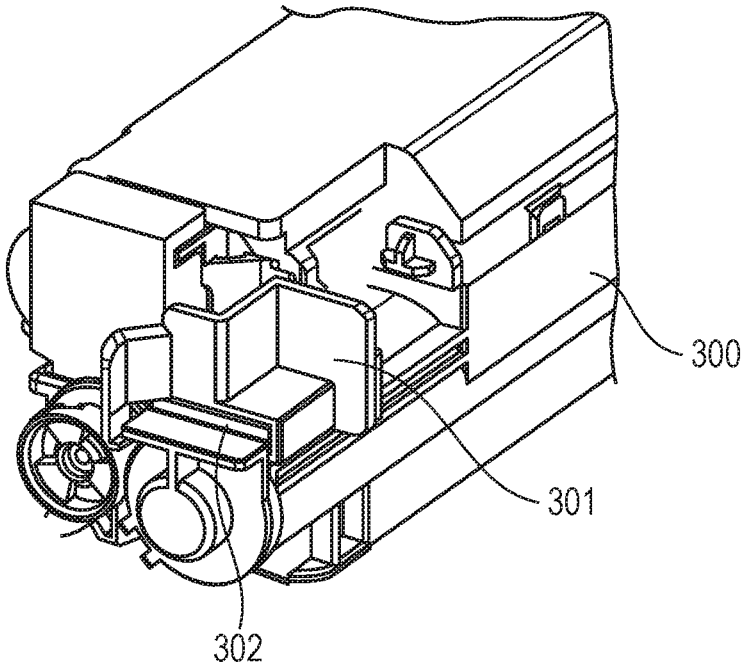
FIG. 6A is a perspective view of a perimeter of a shutter member of the developing unit when blocking a replenishment port.
Figure 6B:
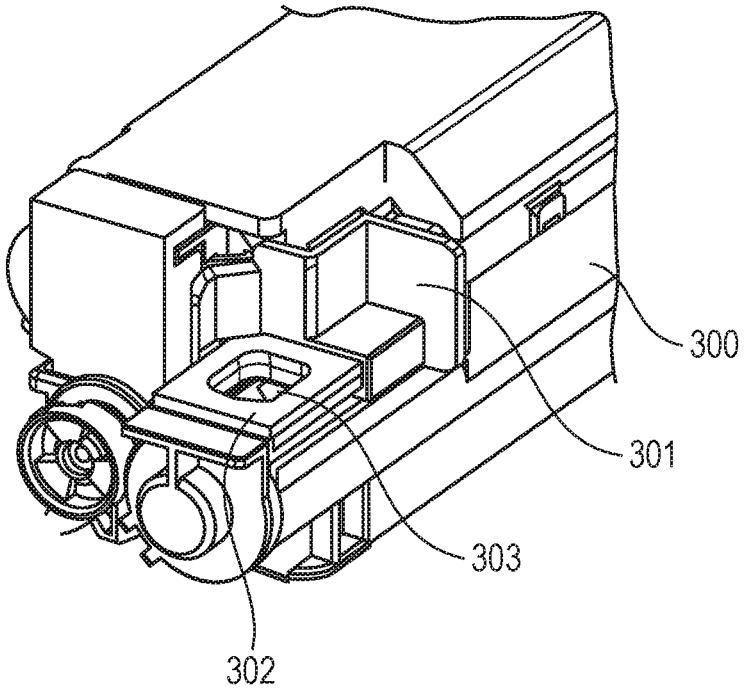
FIG. 6B is a perspective view of the perimeter of a shutter member of the developing unit when releasing the replenishment port.

Next, referring to FIG. 3 to FIGS. 6A and 6B, the developing unit 220 will be described more in detail. FIG. 5 is a perspective view illustrating a rear side, left side, and upper side of the developing unit 220. FIGS. 6A and 6B are perspective views illustrating a vicinity of an end portion of the rear side of the developing unit 220.

In the present embodiment, the developing unit 220 is a developing device of a two-component development system in which a two-component developer containing a toner (a non-magnetic toner particle) and a carrier (a magnetic carrier particle) is used as a developer.

As illustrated in FIG. 3 and FIG. 4, the developing unit 220 includes a developing unit container 300 that is adapted to contain the developer. In the developing unit container 300, the developing unit 220 includes the developing roller 211 as a developer bearing member. The developing roller 211 includes a hollow-cylindrical developing sleeve that is rotatable and formed of a non-magnetic material and a magnet that is disposed on the hollow of the developing sleeve so as not to rotate. The developing roller 211 is supported in the developing unit container 300 in such a manner that a portion of the developing roller 211 is exposed to an outside through an opening that is provided in the developing unit container 300 at a portion opposed to the photosensitive drum 210. The rotation axis of the developing roller 211 and the rotation axis of the photosensitive drum 210 are substantially in parallel with each other. When mounted in the apparatus body 100A, the developing unit 220 becomes able to perform developing action. In a situation of being able to perform the developing action, the developing unit 220 is disposed close to the drum unit 270 so that a distance between the developing roller 211 and the photosensitive drum 210 is a predetermined distance.

As illustrated in FIG. 4, the developing unit 220 includes, in the developing unit container 300, a first conveying screw 212 and a second conveying screw 213 as conveying members. The first conveying screw 212 and the second conveying screw 213 convey a toner that is replenished from the toner replenishing unit 222 to the developing roller 211.

As illustrated in FIG. 5, the developing unit 220 is provided with a replenishment port 303 as an opening, in the end portion on the rear side of the developing unit 220. The replenishment port 303 allows a toner from the toner replenishing unit 222 to be brought into the developing unit container 300. The replenishment port 303 is disposed directly above the first conveying screw 212, which is one disposed the farthest from the developing roller 211 of the first conveying screw 212 and the second conveying screw 213. The developing unit 220 is provided with a shutter member 301 that is adapted to open/close the replenishment port 303, and a seal 302 that is disposed between the shutter member 301 and the developing unit container 300, and adapted to seal a perimeter of the replenishment port 303.

The inside of the developing unit container 300 is filled with a quantity of the developer to the extent that the first conveying screw 212 and the second conveying screw 213 are covered with the developer. Depending on how to handle the developing unit 220 after removing the developing unit 220 from the apparatus body 100A, the inside of the developing unit container 300 may be filled with the developer in a state where the developer is deviated toward the rear side or the front side. When the developer is deviated toward the rear side, the developing unit container 300 is filled with the developer up to directly below the shutter member 301.

The developing unit 220 is attached to and detached from the apparatus body 100A, or replaced. Therefore, when the developing unit 220 is removed from the apparatus body 100A, the shutter member 301 blocks the replenishment port 303 as illustrated in FIG. 6A. The developer is thus prevented from leaking out from the inner portion of the developing unit container 300 to the outside through the replenishment port 303. Around the replenishment port 303, the seal 302 is disposed between the shutter member 301 and the developing unit container 300. This seal 302 seals a gap between the shutter member 301 and the developing unit container 300 so that the developer does not leak out from the gap. When the developing unit 220 is mounted in the apparatus body 100A, the shutter member 301 moves as illustrated in FIG. 6B. The replenishment port 303 is then released to be exposed to the outside. To this replenishment port 303, the toner replenishing unit 222 is coupled. The opening/closing of the shutter member 301 will be described later more in detail.

4. Developing Unit Separate/Approach Mechanism

Next, description will be made about a separate/approach unit that is configured to cause the developing unit 220 to approach or separate from the photosensitive drum 210.

FIG. 4 illustrates a state where the developing unit 220 is mounted in the apparatus body 100A and becomes able to perform developing action. In this state, the developing unit 220 is disposed close to the photosensitive drum 210. Assume that a relative position relationship between the developing unit 220 and the photosensitive drum 210 is kept unchanged in a cross section that is substantially perpendicular to the rotation axis of the photosensitive drum 210. Then, if the developing unit 220 is inserted or extracted in the front-back direction, damage such as a scratch will occur on the photosensitive drum 210 or the developing roller 211. For that reason, attachment or detachment of the developing unit 220 or the drum unit 270 with respect to the apparatus body 100A is desirably performed after the developing unit 220 is separated from the photosensitive drum 210 at a sufficient distance so that the photosensitive drum 210 and the developing roller 211 do not rub against each other.

A conceivable method is that the developing unit 220 and the drum unit 270 are integrally removed from the apparatus body 100A together and then divided. However, this method significantly decreases a replacing workability of the units.

It can be said that the most reliable method for separating the developing unit 220 from the photosensitive drum 210 is to move the developing unit 220 in a direction of a straight line that connects a rotation center of the developing roller 211 and a rotation center of the photosensitive drum 210 in FIG. 4 (toward the lower left of FIG. 4). In the present embodiment, however, the plurality of process units U are arranged in the horizontal direction. Therefore, to move the developing unit 220 in a direction close to the horizontal direction, it is necessary to increase a distance between the adjacent process unit U and the developing unit 220 so that the developing unit 220 does not interfere with an adjacent process unit U. Thus, in the present embodiment, a space below the developing unit 220 is used to move the developing unit 220 in a substantially vertical direction, so as to separate the developing unit 220 from the photosensitive drum 210. A vertical component in the moving direction of the developing unit 220 allows the downsizing of the image forming apparatus 100.

Figure 7A:
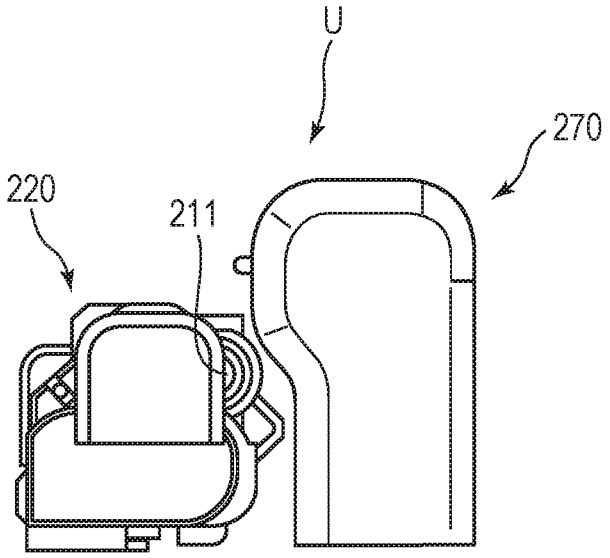
FIG. 7A is a front view of the process unit with the developing unit disposed at a separating position.
Figure 7B:
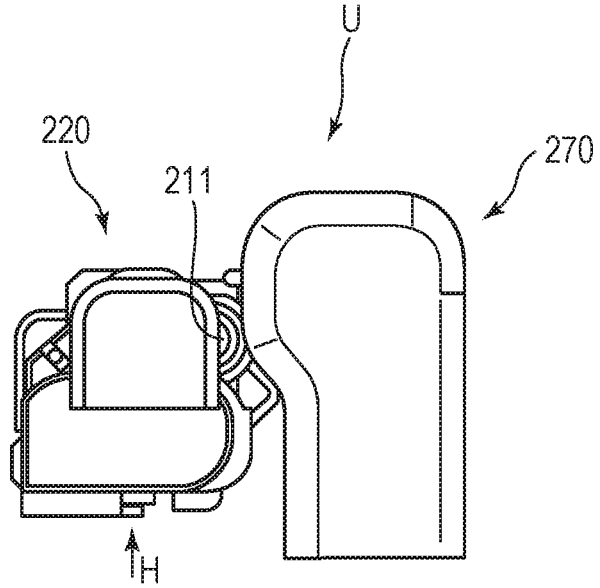
FIG. 7B is a front view of the process unit with the developing unit disposed at an approaching position.

FIGS. 7A and 7B are front views of a process unit U when viewed from the front side. FIG. 7B illustrates a state where the developing unit 220 is disposed at a first position (hereafter, also referred to as an "approaching position" or "image forming position") at which the developing unit 220 is close to the photosensitive drum 210 to be able to perform the developing action. FIG. 7A illustrates a state where the developing unit 220 is disposed at a second position (hereafter, also referred to as a "separating position" or "attaching position") at which the developing unit 220 is farther than at the approaching position illustrated in FIG. 7B from the photosensitive drum 210. In the present embodiment, in the state illustrated in FIG. 7B, the developing roller 211 overlaps the drum unit 270 when viewed from the front side. If this positional relationship is kept, the developing unit 220 cannot be inserted or extracted in the front-back direction. In the state illustrated in FIG. 7A, the overlap between the developing roller 211 and the drum unit 270 is released. At the same time, an adequate gap is secured between the developing unit 220 and the drum unit 270. Therefore, in the state illustrated in FIG. 7A, the developing unit 220 and the drum unit 270 can be inserted or extracted in the front-back direction individually without damaging the photosensitive drum 210 or the developing roller 211.

In the present embodiment, to mount the developing unit 220 in the apparatus body 100A and bring the developing unit 220 into a state that allows the developing unit 220 to perform the developing action, the following procedure including two stages is executed. First, the developing unit 220 is inserted from the front side to the rear side of the apparatus body 100A in the arrow G direction in FIG. 2. The developing unit 220 thereafter is moved upward in the substantially vertical direction indicated by an arrow H in FIG. 7B, so as to be caused to approach the photosensitive drum 210.

Figure 8:
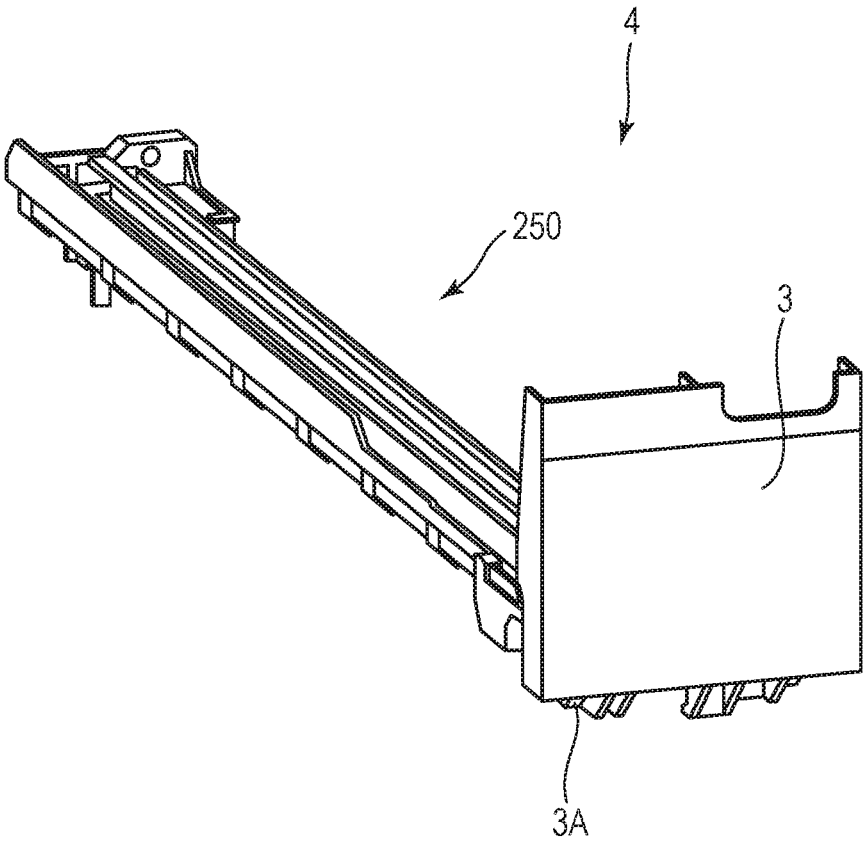
FIG. 8 is a perspective view of a developing unit separate/approach mechanism.
Figure 9A:
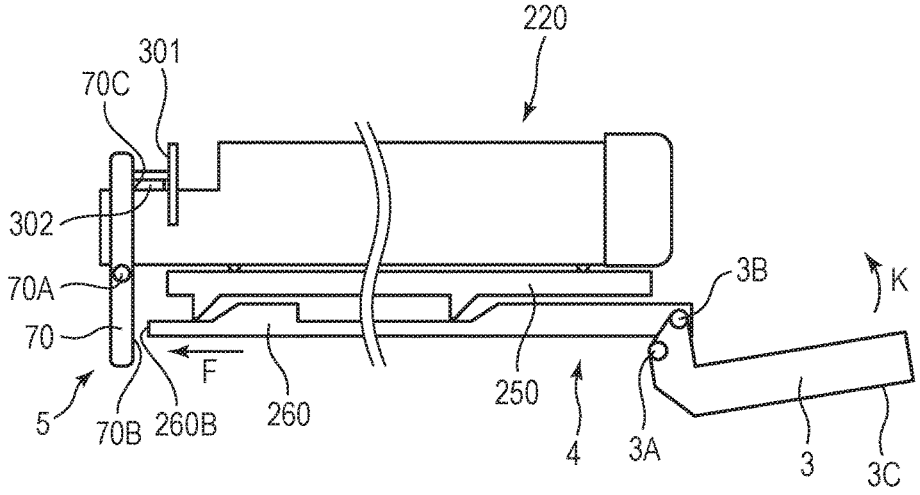
FIG. 9A is a side view of the developing unit separate/approach mechanism with the developing unit disposed at the separating position.
Figure 9B:
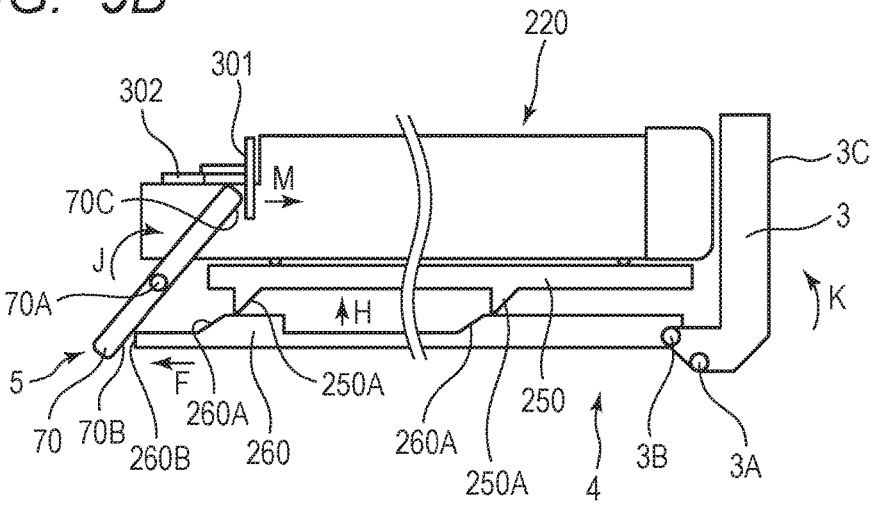
FIG. 9B is a side view of the developing unit separate/approach mechanism with the developing unit disposed at the approaching position.

Referring to FIG. 8, and FIGS. 9A and 9B, a separate/approach mechanism 4 as the separate/approach unit will be described. In the present embodiment, in each of the four process units U, a configuration and an operation of the separate/approach mechanism 4 are substantially the same. Therefore, description will be made about a process unit U as representative of the four process units U. FIG. 8 is a perspective view illustrating a front side, left side, and upper side of the separate/approach mechanism 4. FIGS. 9A and 9B are side views of the separate/approach mechanism 4 when viewed from the left side (the developing unit 220 and a shutter member moving mechanism are also illustrated). FIG. 9A illustrates a state where the developing unit 220 is disposed at the separating position illustrated in FIG. 7A. FIG. 9B illustrates a state where the developing unit 220 is disposed at the approaching position illustrated in FIG. 7B.

As illustrated in FIG. 8, and FIGS. 9A and 9B, the separate/approach mechanism 4 includes a developing rail 250, a separating link 260, and the small cover 3. The developing rail 250 serving as a supporting unit is adapted to guide the insertion/extraction of the developing unit 220. The developing rail 250 also serves as a supporting base for the developing unit 220 when mounting the developing unit 220 in the apparatus body 100A. The developing rail 250 is provided in the apparatus body 100A in such a manner as to be movable in a vertical direction and not movable in the front-back direction (a slight movement such as play is tolerated). The developing rail 250 is coupled with the small cover 3 with the separating link 260 serving as an acting member (developing device moving member) interposed therebetween. The separating link 260 is provided in the apparatus body 100A in such a manner as to be movable in the front-back direction. The small cover 3 is held in the apparatus body 100A in such a manner as to be freely pivotable about a pivot axis 3A. An axis line direction of the pivot axis 3A is substantially parallel to the horizontal direction and extends in a right and left direction. A cover portion 3C is provided on one end side in a pivot radius direction of the small cover 3 and is formed so as to cover at least a portion of an end portion on the front side of the process unit U. The small cover 3 and the separating link 260 are pivotably coupled with each other by a link shaft 3B that is provided at a leading edge on the other end side of the small cover 3 in the pivot radius direction. An axis line direction of the link shaft 3B is substantially parallel to the horizontal direction and extends in the right and left directions. In this configuration, causing the small cover 3 to pivot can cause the separating link 260 to slide in the front-back direction. As seen from the above, in the present embodiment, the small cover 3 has a function as a cover member that is adapted to cover at least a portion of the developing unit 220, as well as a function as a lever member that is adapted to cause the separate/approach mechanism 4 to work.

The procedure for mounting the developing unit 220 in the apparatus body 100A and bringing the developing unit 220 into the state that allows the developing unit 220 to perform the developing action is as follows. First, as illustrated in FIG. 9A, the developing unit 220 is inserted from the front side to the rear side of the apparatus body 100A, with the small cover 3 opened. At that point, the developing unit 220 is inserted while guided by the developing rail 250, so as not to rub against the photosensitive drum 210. FIG. 9A illustrates a state where the insertion of the developing unit 220 into the apparatus body 100A is finished. At that point, the shutter member 301 for blocking the replenishment port 303 is not closed yet.

In the state illustrated in FIG. 9A, the small cover 3 is caused to pivot in an arrow K direction (counterclockwise direction), the link shaft 3B then pivots in the same direction, and the separating link 260 moves in an arrow F direction (direction from the front side toward the rear side). The separating link 260 includes, on an upper surface thereof, a link slope 260A as a moving direction converting unit. The developing rail 250 includes, on a bottom surface thereof, a rail slope 250A as a receiving portion. The link slope 260A and the rail slope 250A are disposed in such a manner as to be engaged with each other by the separating link 260 moving in the arrow F direction. Therefore, when the separating link 260 moves in the arrow F direction, the link slope 260A pushes the rail slope 250A upward in the substantially vertical direction, as illustrated by an arrow H in FIG. 9B. That is, the rail slope 250A is moved from a concave portion that is relatively low in the separating link 260 to a convex portion that is relatively high in the separating link 260. As a result, the developing unit 220 supported by the developing rail 250 is caused to move upward in the substantially vertical direction. This upward movement in the substantially vertical direction brings the developing unit 220 from the state where the developing unit 220 is at the separating position (FIG. 7A) into the state where the developing unit 220 is at the approaching position (FIG. 7B).

A procedure for removing the developing unit 220 from the apparatus body 100A is one that is opposite to the above-described procedure. That is, in the state illustrated in FIG. 9B, the small cover 3 is caused to pivot in a direction reverse to the arrow K (clockwise direction), and the separating link 260 then moves in a direction reverse to the arrow F (direction from the rear side toward a frontward side). This movement causes, as illustrated in FIG. 9A, the rail slope 250A to move downward in the substantially vertical direction while sliding on the link slope 260A. That is, the rail slope 250A is moved from the convex portion that is relatively high in the separating link 260 to the concave portion that is relatively low in the separating link 260. As a result, the developing unit 220 is moved downward in the substantially vertical direction, so as to be caused to separate from the photosensitive drum 210. The developing unit 220 is thereafter caused to move from the rear side to the front side along the arrow G direction in FIG. 2, so as to be extracted from the apparatus body 100A.

As illustrated in FIG. 9B, when the small cover 3 is closed (see FIG. 1), the developing unit 220 and the drum unit 270 are both inaccessible. The small cover 3 is also useful for preventing an operation error such as the insertion/extraction of the developing unit 220 close to the photosensitive drum 210.

5. Shutter Member Moving Mechanism

Next, description will be made about a moving unit for moving the shutter member 301.

The developing unit is provided with the shutter member that is adapted to open/close the replenishment port. The shutter member is often adapted to open in response to an inserting operation of the developing unit after the insertion of the developing unit into the apparatus body has been finished. Some states of the developing unit may however make the developing unit container filled with the developer to directly below the shutter member. Therefore, if the developing unit is inserted into the apparatus body with a great force, the force or a vibration occurring with the opening of the shutter member may make the developer spill out of the developing unit container in the inserting direction of the developing unit through the replenishment port to be scattered in the apparatus body. The scattered developer may be adhered to an unintended portion in an image forming region, and a poor image may occur when the scattered developer reaches a sheet. When the scattered developer is adhered to a drum unit to be replaced by a user, a hand of the user may be stained.

In contrast, in the present embodiment, as illustrated in FIG. 9A, the shutter member 301 is not opened yet when the insertion of the developing unit 220 into the apparatus body 100A is finished. Therefore, a force occurring in the insertion does not cause the developer to be scattered in the apparatus body 100A. In the present embodiment, as will be described below, the developing unit 220 is moved from the separating position to the approaching position by the separate/approach mechanism 4, and the shutter member 301 opens in response thereto, so that the replenishment port 303 is released.

With reference to FIGS. 9A and 9B, the moving mechanism 5 serving as the moving unit will be described. In the present embodiment, in each of the four process units U, a configuration and an operation of the moving mechanism 5 are substantially the same. Therefore, description will be made about a process unit U as representative of the four process units U. FIGS. 6A and 6B, FIGS. 7A and 7B, and FIGS. 9A and 9B illustrate states where the developing unit 220 is at the respective positions.

In the present embodiment, the moving mechanism 5 includes a pivot link 70 as a shutter moving member. The pivot link 70 is held in the apparatus body 100A on a rear side in the apparatus body 100A in such a manner as to be freely pivotable about the moving member rotating shaft 70A. An axis line direction of the moving member rotating shaft 70A is substantially parallel to the horizontal direction and extends in a right and left direction. The pivot link 70 includes a link engaging portion 70B that is provided on one end side in a pivot radius direction of the pivot link 70 and disposed in such a manner as to be engageable with an end portion 260B on the rear side of the separating link 260. The pivot link 70 includes a shutter engaging portion 70C that is the other end portion of the pivot link 70 in the pivot radius direction and disposed in such a manner as to be engageable with the shutter member 301 of the developing unit 220.

In the state illustrated in FIG. 9A, the link engaging portion 70B of the pivot link 70 is not engaged with the separating link 260, and the shutter engaging portion 70C of the pivot link 70 is not engaged with the shutter member 301. As long as the shutter member 301 can be kept closed, the link engaging portion 70B and the shutter engaging portion 70C may be in contact respectively with the separating link 260 and the shutter member 301 at this point. In the state illustrated in FIG. 9A, when the separating link 260 moves in the arrow F direction (direction from the front side to the rear side) as the small cover 3 pivots in the arrow K direction (counterclockwise direction), the link engaging portion 70B becomes to be engaged with the separating link 260. Then, as illustrated in FIG. 9B, the pivot link 70 pivots in an arrow J direction (clockwise direction), and the shutter engaging portion 70C becomes engaged with the shutter member 301. This engagement gives the shutter member 301 a force that causes the shutter member 301 to move in an arrow M direction (direction from the rear side toward the front side), so that the shutter member 301 opens.

In the present embodiment, a moving direction of the shutter member 301 intersects (substantially at right angles in the present embodiment) with the moving direction of the developing unit 220 between the approaching position and the separating position and is substantially parallel to a moving direction of the separating link 260. In the opening of the shutter member 301, the moving direction of separating link 260 and the moving direction of the shutter member 301 are opposite to each other. The pivot link 70 converts a force in the moving direction of the separating link 260 into a force in a direction of opening the shutter member 301. In the present embodiment, an inserting/extracting direction (mounting direction) of the developing unit 220 with respect to the apparatus body 100A intersects (substantially at right angles in the present embodiment) with the moving direction of the developing unit 220 between the approaching position and the separating position and is substantially parallel to the moving direction of the separating link 260.

In the present embodiment, an operation for closing the small cover 3 causes the developing unit 220 to move in a direction of approaching the photosensitive drum 210 and causes the shutter member 301 to open. In such a case, even in a state where the developing unit container is filled with the developer up to directly below the replenishment port 303, the developer does not spill out of the developing unit container 300 through the replenishment port 303, or an amount of spilled developer is significantly reduced. The reason for this effect is as follows. That is, the shutter member 301 opens in conjunction with the movement of the developing unit container 300 along the substantially vertical direction. Therefore, even if the developing unit container 300 is moved with a great force, the developer in the developing unit container 300 is shaken only vertically. The developer thus receives no force that causes the developer to spill out of the developing unit container 300. For this reason, the developer can be prevented from being scattered into the apparatus body 100A through the replenishment port 303. The configuration in the present embodiment is simpler than a configuration in which the shutter member is opened by a motor after the developing unit is mounted. Therefore, this configuration allows for reduction in cost and size. The configuration in the present embodiment has a better mounting workability of the developing unit 220 than a configuration in which the developing unit is once stopped by a braking unit immediately before the shutter member is opened.

The direction (arrow H direction) of causing the developing unit 220 to approach the photosensitive drum 210 is desirably, substantially perpendicular to a direction of a force that causes the shutter member 301 to open (the arrow M direction). Here, a case is considered where the direction of the force that causes the shutter member 301 to open is in the substantially vertical direction. For example, as such, a conceivable case is that a link with a slope is engaged with the shutter member 301 from below, so as to open the shutter member 301. In this case, a component force of the force that causes the shutter member 301 to open is added to a force that causes the developing unit 220 to approach the photosensitive drum 210. This addition of forces may consequently cause a twist that occurs in the developing unit container 300 or a difference in a distance between the developing roller 211 and the photosensitive drum 210 that occurs between the front and the rear of the developing unit container 300 in a longitudinal direction of the developing unit container 300. Here, the angle at which the direction of causing the developing unit 220 to approach the photosensitive drum 210 intersects substantially at right angles with the direction of the force that causes the shutter member 301 to open is not limited to a case of a perfect right angle. The angle may deviate from a right angle within a range at a level of an error (e.g., about 10 degrees).

A procedure for closing the shutter member 301 is one that is opposite to the above-described procedure. That is, in the state illustrated in FIG. 9B, the small cover 3 is caused to pivot in a direction reverse to the arrow K (clockwise direction), and the separating link 260 then moves in a direction reverse to the arrow F (direction from the rear side toward a frontward side). This movement causes the separating link 260 to retract from the link engaging portion 70B of the pivot link 70 and causes the shutter engaging portion 70C of the pivot link 70 to retract from the shutter member 301. In the present embodiment, the shutter member 301 is biased in a direction in which the shutter member 301 is closed by a spring as a biasing unit. Therefore, as the shutter engaging portion 70C retracts from the shutter member 301, the shutter member 301 is closed and brought into the state illustrated in FIG. 9A.

In the present embodiment, the image forming apparatus 100 includes the separate/approach unit 4 that is configured to move developing device 220 between the first position (approaching position) and the second position (separating position) farther than the first position from the image bearing member 210. The image forming apparatus 100 also includes the moving unit 5 that is interlocked with the separate/approach unit 4 causing the developing device 220 to move from the separating position to the approaching position, so as to move the shutter member 301 from a closed position at which the shutter member 301 blocks the replenishment port 303 to an opened position at which the replenishment port 303 is released. This moving unit 5 is interlocked with the separate/approach unit 4 causing the developing device 220 to move from the approaching position to the separating position, so as to enable the shutter member 301 to move from the opened position to the closed position. After being moved from the approaching position to the separating position by the separate/approach unit 4, the developing device 220 becomes able to be extracted from the apparatus body 100A along a direction that intersects with a moving direction of the developing device 220 between the approaching position and the separating position. In addition, after being inserted into the apparatus body 100A along a direction that intersects with the moving direction of the developing device 220 from the approaching position to the separating position, the developing device 220 is moved from the separating position to the approaching position by the separate/approach unit 4.

In the present embodiment, the separate/approach unit 4 includes the acting member 260 that is adapted to move developing device 220 between the approaching position and the separating position, and the lever member 3 that is configured to move the acting member 260. In the present embodiment, the moving unit 5 includes the moving member 70 that is adapted to be moved by the acting member 260, so as to cause the shutter member 301 to move from the closed position to the opened position. In particular, in the present embodiment, the lever member 3 also serves as a cover member that is adapted to cover at least a portion of the developing device 220 and is movable between a shutting position and a releasing position. The cover member at the shutting position disables insertion and extraction of the developing device 220 with respect to the apparatus body 100A. The cover member at the releasing position enables the insertion and the extraction. By moving the cover member 3 from the releasing position to the shutting position with the developing device 220 inserted into the apparatus body 100A, the developing device 220 is caused to move from the separating position to the approaching position. In addition, by moving the cover member 3 from the shutting position to the releasing position with the developing device 220 inserted into the apparatus body 100A, the developing device 220 is caused to move from the approaching position to the separating position. In the present embodiment, the shutter member 301 moves in a direction substantially perpendicular to the moving direction of the developing device 220 between the approaching position and the separating position, so as to open/close the replenishment port 303.

As seen from the above, the present embodiment can prevent, with a simple configuration, the developer from being scattered in the apparatus body 100A in the mounting of the developing unit 220 without decreasing the mounting workability of the developing unit 220.

[Other Respects]

The present invention has been described above based on a specific embodiment. However, the present invention is not limited to the above-described embodiment.

For example, in the above-described embodiment, the developer bearing member of the developing device is disposed close to the image bearing member when the developing device is at the approaching position. The developer bearing member may however abut against the image bearing member. When the developing device is at the approaching position, a portion of the developing device may abut against the image bearing member or a unit including the image bearing member in order to maintain a distance between the developer bearing member and the image bearing member.

In the above-described embodiment, the moving direction of the developing device between the approaching position and the separating position is the substantially vertical direction. The present invention is however not limited to such an aspect. For example, the present invention is applicable even to a case where the developing device is moved in a direction of a straight line that passes through a rotation center of the image bearing member and a rotation center of the developer bearing member. In this case, for example, a change of the moving direction of the developing device can be dealt with by changing a shape of the slope formed on the separating link and the developing rail and a direction of opening/closing the small door that have been described in the above-described embodiment.

In the above-described embodiment, the image forming apparatus is a color image forming apparatus including a plurality of process units. However, the present invention is also applicable to a monochrome image forming apparatus, which includes a single process unit.

In the above-described embodiment, the image forming apparatus employs an electrophotographic process, and the image bearing member is a photosensitive member. However, when the image forming apparatus employs an electrostatic recording process, the image bearing member may be an electrostatic recording dielectric.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-225549, filed Nov. 18, 2016, which is hereby incorporated by reference herein in its entirety.

What is claimed is:

1. An image forming apparatus comprising:

an image bearing member;

a developing unit including a developing container configured to contain developer and a developer carrying member configured to carry the developer for developing an electrostatic latent image formed on the image bearing member, the developing unit being mountable to a mounting portion of the image forming apparatus;

a developer replenishing portion configured to replenish the developer to the developing container;

a developer receiving port disposed in the developing container and configured to receive the developer replenished by the replenishing portion;

a shutter disposed in the developing unit and movable from a shielding position in which the shutter shields the developer receiving port to an open position in which the shutter opens the developer receiving port;

a first moving mechanism configured to move the developing unit from a first position to a second position in a state in which the developing unit is mounted to the mounting portion of the image forming apparatus, the developer carrying member being in a developing position in which the developer carrying member is in non-contact with the image bearing member and develops the electrostatic latent image formed on the image bearing member when the developing unit is in the second position, the developer carrying member being in a separating position in which the developer carrying member is in non-contact with the image bearing member and separated from the developing position when the developing unit is in the first position, a shortest distance between the developer carrying member and the image bearing member when the developing unit is in the second position being shorter than a shortest distance between the developer carrying member and the image bearing member when the developing unit is in the first position;

a second moving mechanism configured to move the shutter from the shielding position to the open position in conjunction with an operation in which the first moving mechanism moves the developing unit from the first position to the second position;

a cover member which is rotatable and configured to cover at least a portion of the developing unit;

a link member connected to the cover member and movable in a mounting direction in which the developing unit is mounted to the mounting portion of the image forming apparatus in conjunction with an operation in which the cover member is rotated in a predetermined rotation direction; and an engaging member provided so as to engage with the shutter and moveable relative to the shutter in a state in which the engaging member engages with the shutter in conjunction with an operation in which the link member is moved in the mounting direction by rotating the cover member in the predetermined rotation direction, wherein in conjunction with the operation in which the link member is moved in the mounting direction by rotating the cover member in the predetermined rotation direction in the state in which the developing unit is mounted to the mounting portion of the image forming apparatus, the first moving mechanism moves the developing unit from the first position to the second position, and wherein in conjunction with the operation in which the link member is moved in the mounting direction by rotating the cover member in the predetermined rotation direction in the state in which the developing unit is mounted to the mounting portion of the image forming apparatus, the engaging member is moved relative to the shutter in the state in which the engaging member engages with the shutter, so that the second moving mechanism moves the shutter from the shielding position to the open position.

2. The image forming apparatus according to claim 1, further comprising a guide portion configured to guide the developing unit in the mounting direction, wherein the first moving mechanism moves the developing unit from the first position to the second position in a state in which the developing unit is guided in the mounting direction by the guide portion and then mounted to the mounting portion of the image forming apparatus, and wherein the second moving mechanism moves the shutter from the shielded position to the open position in the state in which the developing unit is guided in the mounting direction by the guide portion and then mounted to the mounting portion of the image forming apparatus.

3. The image forming apparatus according to claim 1, wherein when the developing unit is dismounted from the mounting portion of the image forming apparatus, the shutter is movable from the open position to the shielded position, wherein the first moving mechanism moves the developing unit from the second position to the first position in the state in which the developing unit is mounted to the mounting portion of the image forming apparatus, and wherein in conjunction with an operation in which the first moving mechanism moves the developing unit from the second position to the first position in the state in which the developing unit is mounted to the mounting portion of the image forming apparatus, the second moving mechanism moves the shutter from the open position to the shielded position.

* * * * *